US007236710B2

(12) United States Patent
Winter et al.

(10) Patent No.: US 7,236,710 B2
(45) Date of Patent: Jun. 26, 2007

(54) ARRANGEMENT AND METHOD FOR DETERMINING THE POSITION OF A UNIT IN AN ELECTROPHOTOGRAPHIC PRINTER OR COPIER

(75) Inventors: Hans Winter, München (DE); Rene-Alois Fröschl, Brunnthal (DE); Reinhold Schmidl, Fürstenfeldbruck (DE)

(73) Assignee: Oce Printing Systems GmbH, Poing (DE)

( * ) Notice: Subject to any disclaimer, the term of this patent is extended or adjusted under 35 U.S.C. 154(b) by 256 days.

(21) Appl. No.: 11/048,590

(22) Filed: Feb. 1, 2005

(65) Prior Publication Data

US 2005/0180765 A1 Aug. 18, 2005

(30) Foreign Application Priority Data

Feb. 13, 2004 (DE) ..... 10 2004 007 195

(51) Int. Cl.
*G03G 15/00* (2006.01)

(52) U.S. Cl. ..... 399/13

(58) Field of Classification Search ..... 399/9, 399/10, 11, 12, 13, 24, 25, 27, 31
See application file for complete search history.

(56) References Cited

U.S. PATENT DOCUMENTS 4,429,985 A 2/1984 Yokota
4,657,372 A * 4/1987 Ikeda et al. ..... 399/13
4,931,837 A * 6/1990 Abuyama et al. ..... 399/13
5,523,822 A * 6/1996 Tsuda ..... 399/13
6,137,517 A 10/2000 Furst et al.
2005/0220461 A1 * 10/2005 Tsusaka ..... 399/13

FOREIGN PATENT DOCUMENTS

| | | |
|---|---|---|
| EP | 0 667 563 | 8/1995 |
| EP | 1 376 267 | 1/2004 |
| WO | WO 98/39691 | 9/1998 |

* cited by examiner

*Primary Examiner*—Hoan Tran
(74) *Attorney, Agent, or Firm*—Schiff Hardin LLP

(57) ABSTRACT

In an arrangement and method for determining a position of a unit in an electrophotographic printer or copier, a sensor arrangement is provided having two sensors and an actuating element. Each sensor outputs a sensor signal dependent on a position of the actuating element, the position of the actuating element with respect to the sensors changing dependent on a position of the unit. In a first position of the unit, the actuating element is positioned such that the first sensor and the second sensor each output a first sensor signal. In a second position of the unit the actuating element is positioned such that the first sensor outputs a second sensor signal and the second sensor outputs the first sensor signal. In a third position of the unit the actuating element is positioned such that the first sensor and the second sensor each output the second sensor signal. In a fourth position of the unit the actuating element is positioned such that the first sensor outputs the first sensor signal and the second sensor outputs the second sensor signal.

11 Claims, 5 Drawing Sheets

ARRANGEMENT AND METHOD FOR DETERMINING THE POSITION OF A UNIT IN AN ELECTROPHOTOGRAPHIC PRINTER OR COPIER

BACKGROUND

The disclosure relates to an arrangement and a method for determining the position of a unit in an electrophotographic printer or copier. The arrangement includes a sensor arrangement which outputs a sensor signal dependent on the position of the unit.

Modern high-performance printers with printing speeds of more than 150 sheets DIN A4 per minute are modularly structured so that a quick replacement of units can be carried out. Further, such a modular structure allows a simple and quick maintenance as well as simple and quick cleaning possibilities of the unit of the electrophotographic printer. In particular, up to five developer stations per printing unit are included in such high-performance printers, common high-performance printers having at least two printing units. For cleaning and maintenance services, individual developer stations can be taken out of the printer or copier as units and/or can be brought into an appropriate cleaning and/or maintenance position for these services.

In order to enable a multi-color-printing, in known high-performance printers several developer stations are allocated to a printing unit and are swung into contact with a photoconductor or will be swung into contact therewith depending on the operating state. These developer stations contain various colors, in particular black, magenta, cyan, yellow and/or customized colors. It must be possible for service technicians to easily replace such developer stations and for an operator to easily clean the same. For cleaning and replacement, first, all developer stations are successively swung away from the photoconductor. Each developer station has at least an own drive unit which serves to mix the toner particles and the toner particle mixture as well as to supply toner material. For removing the developer station from the printer, usually a locking that prevents the developer station from being taken out has to be released.

In a high-performance printer described in the International Patent Application WO 98/39691, for the purpose of cleaning a developer station the mechanical locking of a developer station has to be released in the swung-out printing position by pulling out a locking pin. Subsequently, the developer station is pulled out up to the cleaning position. In the cleaning position the locking pin engages in an aperture provided therefor. As a result, the developer station is in the cleaning position and can be cleaned by the operator. After cleaning, the engaged locking pin has to be released and the developer station has to be pushed in up to the swung-out printing position. In the printing position the locking pin engages in a second aperture provided therefor. The developer station is thus fixed and secured in the printing position. The content of the International Patent Application WO 98/39691 is incorporated by reference into the present application.

When the developer station in the high-performance printer described in WO 98/39691 is to be replaced, then the locking of the developer station in the swung-out printing position has to be released by pulling out the locking pin and the developer station has to be pulled out up to the stop in the same manner as for cleaning the developer station. Subsequently, the total locking of the developer station has to be released and the station has to be lifted out. Thereafter, the new developer station is placed therein and is secured against removal by means of the total locking. Subsequently the developer station is pushed into the printer up to the swung-out printing position in which the locking pin engages in the aperture provided therefor.

When a developer station of a printing unit is to be cleaned or replaced, then first all developer stations have to be swung away from the photoconductor. After the cleaning or the replacement, i.e. when the cleaned or replaced developer station is again in the swung-out printing position, all stations are again successively swung into contact and the printing operation is enabled.

Both a control unit arranged on the developer unit for controlling the sequence of operations of the developer station and the at least one drive arranged on the developer station are only supplied with current and are operational after the developer station has been swung into contact.

When the developer stations are successively swung into contact, it has to be guaranteed that the stations which are swung into contact are locked in the printing position, since otherwise, when the stations are serially swung into contact, collisions between the individual stations might occur. Further, the motors for the swing motions which are provided at mounting locations where no stations are installed must not be actuated or activated. In the prior art, the position of the developer station is merely ensured by the locking pin. When, however, the developer station is not correctly pushed in up to the printing position after cleaning or after replacement, then the motor for the swing motions will nevertheless be activated and tries to swing the incorrectly positioned developer station into contact. This may result in damage to the printer, the developer station to be swung into contact, or to adjacent developer stations.

SUMMARY

An object is to specify an arrangement and a method by which the position of a unit in an electrophotographic printer or copier can be determined safely and clearly.

In a method and arrangement for determining the position of a unit in an electrophotographic printer or copier, providing a sensor arrangement comprising two sensors and an actuating element, and outputting with each sensor a sensor signal dependent on a position of the actuating element. A position of the actuating element with respect to the sensors is changed dependent on a position of the unit. The actuating element is positioned such that: in a first position of the unit the first sensor and the second sensor each output a first sensor signal; in a second position of the unit the first sensor outputs the second sensor signal and the second sensor outputs the first sensor signal; in a third position of the unit the first sensor and the second sensor each output the second sensor signal; and in a fourth position of the unit the first sensor outputs the first sensor signal and the second sensor outputs the second sensor signal.

DESCRIPTION OF THE PREFERRED EMBODIMENT

Figure 1:
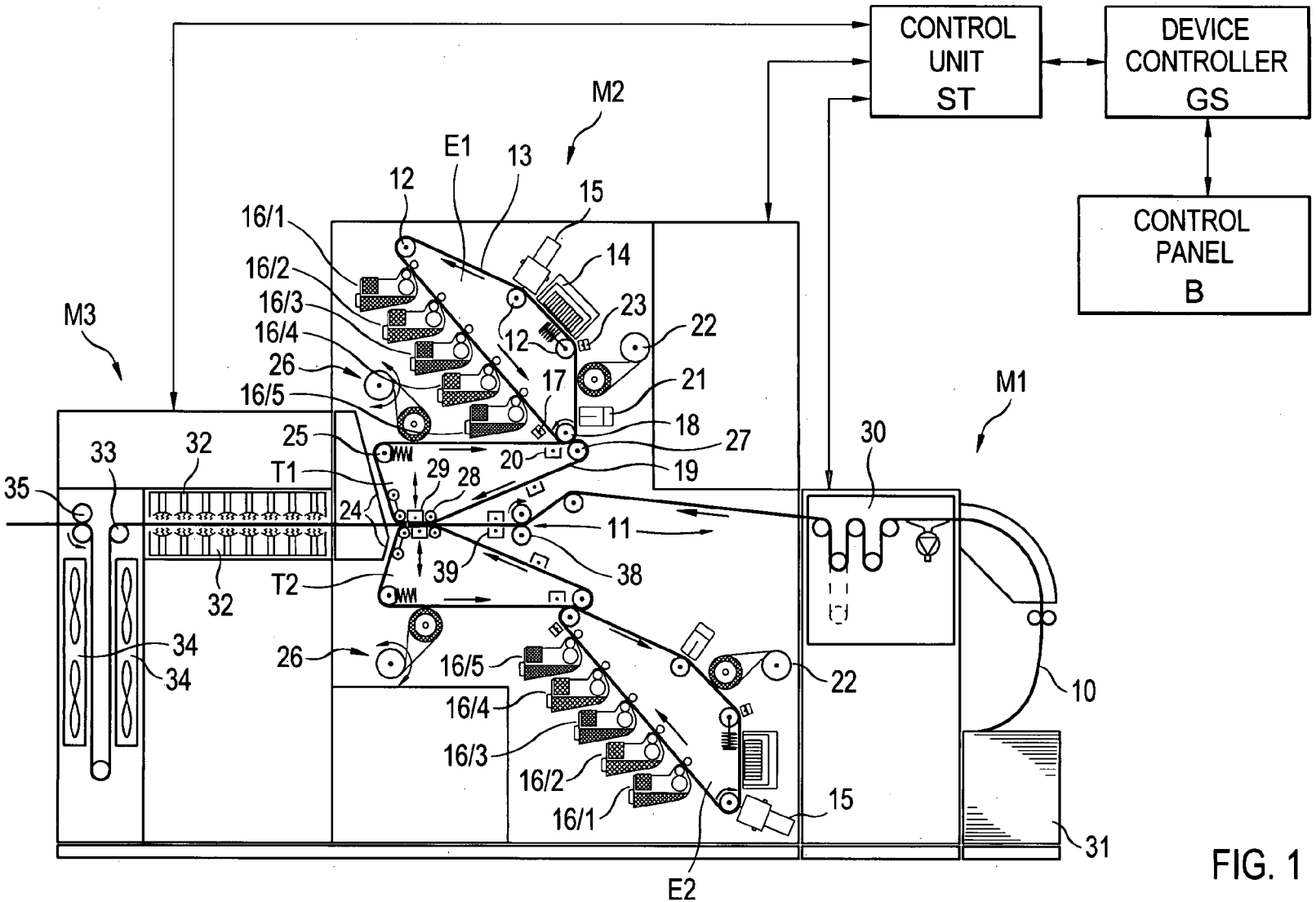
FIG. 1 is a schematic illustration of a high-performance printer.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

With the aid of an arrangement for determining the position of a unit in an electrophotographic printer or copier it is possible to determine the position of a unit, in particular of a developer station, sufficiently precisely. As a result it can be guaranteed that the unit is in an operating position prior to the enablement of the unit for the operation of the printer or copier. Damage to the unit and the printer is thus avoided. It is advantageous to compare the sequence of the successively determined positions with preset position patterns in order to especially determine a defective sensor arrangement or a defective sensor.

A second aspect relates to a method for determining the position of a unit in an electrophotographic printer or copier. In this method, a sensor signal is determined for each sensor by means of a sensor arrangement comprising two sensors and an actuating element. Each sensor outputs a sensor signal dependent on the position of the actuating element. The position of the actuating element with respect to the sensors is changed dependent on the position of the unit. In a first position of the unit, the actuating element is positioned such that the first sensor and the second sensor each output a first sensor signal. In a second position of the unit, the actuating element is positioned such that a second sensor signal is output by the first sensor and the first sensor signal is output by the second sensor. In a third position of the unit, the actuating element is positioned such that the first sensor and the second sensor each output the second sensor signal. Further, in a fourth position of the unit, the actuating element is positioned such that the first sensor signal is output by the first sensor and the second sensor signal is output by the second sensor.

This method for determining the position of a unit easily allows the determination of the position of the unit in the printer or copier with sufficient precision in order to implement control operations in the printer or copier dependent on the position of the unit. Thus, in the case of a non-exact positioning of the unit in a predetermined operating state, it can be prevented that the unit and/or the printer or copier are damaged or destroyed by an incorrect positioning of the unit.

In FIG. 1, a high-performance printer having a modular structure is schematically illustrated. The printer comprises a supply module M1, a printing module M2 and a fixing module M3. Each module includes a plurality of units of which at least a part can easily be removed from and/or pulled out of the printer for service and maintenance works as well as for cleaning purposes.

The supply module M1 includes a loop former 30 which keeps the endless recording medium 10 comprised of paper under a constant tension both in the continuous operation as well as in the start-stop-operation so that the recording medium does not tear in the different operating states as well as during the change between the operating states and can continuously be supplied to the printing module M2. The loop former 30 thus functions as a web storage and as a buffer for the recording medium 10 which is continuously drawn off from a stacking device 31.

The printing module M2 includes aggregates required for printing toner images on a band-shaped recording medium 10. The recording medium 10 provided by the supply module M1 is conveyed through a transport channel 11 through the printing module M2 up to the fixing module M3. A first electrophotographic module E1 is arranged above the transport channel 11 or band-shaped recording medium 10 and a second electrophotographic module E2 is arranged below the transport channel 11 or the recording medium 10. One transfer module T1, T2 each is allocated to the electrophotographic modules E1, E2. The first electrophotographic module E1 and the first transfer module T1 form a first upper printing unit and the second electrophotographic module E2 and the second transfer module T2 form a second lower printing unit. The upper printing unit comprising the modules E1 and T1 is provided for generating toner images on the front side of the recording medium 10 and the lower printing unit comprising the modules E2 and T2 is provided for generating toner images on the rear side of the recording medium 10. The electrophotographic modules E1 and E2 as well as the transfer modules T1 and T2 are each substantially identically structured and are mirror-symmetrical with respect to the recording medium 10. Each of the electrophotographic modules includes a photoconductor belt 13, in particular an organic photoconductor (OPC), which is guided over deflection rollers 12 and is driven by an electromotor.

Each of the electrophotographic modules E1 and E2 includes a corotron unit 14 for charging the photoconductor belt 13, a character generator 15, developer stations 16/1, 16/2, 16/3, 16/4, 16/5, a discharge corotron 21 as well as a cleaning station 22. The electrophotographic module E1 further includes a charge reversal corotron 17 which reverses the charge of the toner particles of the toner image present on the photoconductor belt 13 prior to the transfer onto a transfer belt 19 of the transfer module T1 so that the toner particles have a desired charge state during transfer. In the area of a transfer-printing roller 18, the toner image present on the photoconductor belt 13 is transferred from the photoconductor belt 13 onto the transfer belt 19. The transfer of the toner image from the photoconductor belt 13 onto the transfer belt 19 is supported by a corotron 20 lying opposite the transfer roller 18.

The transfer belt 19 is guided over several rollers 25, 27, 28, at least one of these rollers being driven by an electromotor and serving as a drive roller for the transfer belt 19. The roller arrangement 25, 27, 28 is formed such that in a transfer-printing area the transfer belt 19 can be swung into contact with the recording medium 10 and can again be swung away therefrom. In particular in the start-stop-operation, this swing function serves to transfer several, successively generated color separations from the photoconductor belt 13 onto the transfer belt 19 in the swung-out state. In the swung-out state, the transfer belt 19 does not contact the recording medium 10. The individual color separations are generated as explained in the following. A charge image generated with the aid of the character generator 15 is inked with the aid of a first developer station 16/1 with toner material of a first toner color on the photoconductor belt 13 and is then transferred onto the transfer belt 19.

Subsequently, a further charge image is generated with the aid of the character generator 15 on the photoconductor belt 13 and is inked with a second color, i.e. with the aid of a second developer station 16/2. The printer according to FIG. 1 has five developer stations 16/1 to 16/5 for each electrophotographic module E1 and E2, the developer station 16/1 preferably containing toner material of the color yellow, the developer station 16/2 preferably containing toner material of the color magenta, the developer station 16/3 preferably containing toner material of the color cyan, the developer station 16/4 preferably containing toner material of a customized color, for example the color red, and the developer station 16/5 preferably containing toner material of the color black. If one of these colors is not required for printing, the developer station containing this color can be removed from the printer according to FIG. 1.

It is also possible to replace a developer station 16/1 to 16/5 by a developer station containing toner of a further color in order to allow a cost-efficient printing in this color as well. With the aid of the developer stations 16/1, 16/2 and 16/3 a full color print can also be implemented by creating mixed colors with the aid of superimposed toner images. However, it is more cost-efficient and sometimes faster as well to provide a developer station with toner material of a specific color if the color portion of this specific color is high. A toner image generated with one toner color is also referred to as a color separation.

The toner images of different toner colors are as already described successively printed onto the transfer belt 19 with register accuracy so that a total toner image comprising the individual color separations is collected on the transfer belt 19. When all color separations required for the generation of the complete print image are transferred onto the transfer belt 19, the transfer belt 19 is swung into contact with the recording medium 10 in the transfer-printing area, the transfer of the toner images from the upper printing unit and from the lower printing unit onto the recording medium 10 taking place simultaneously and being supported by one corotron 29 each in the transfer-printing area.

The recording medium 10 is transported with the aid of transport rollers 18 through the transport channel 11 and is charged with the aid of a corotron arrangement 39 before it reaches the transfer printing area. The transfer-printing stations with which the transfer belt 19 is swung into contact with the recording medium 10 and away therefrom have the reference character 24 in FIG. 1. For the cleaning of the transfer belt 19 after the transfer-printing of the toner images, one cleaning station 26 each is provided, which is swung into contact with the transfer belt 19 after the transfer-printing in order to remove remaining toner still present on the transfer belt 19 from the transfer belt 19. After the transfer printing of the toner images onto the recording medium 10, the toner images are further guided to the fixing module M3 which includes one infrared fixing unit 32 each for fixing the front side and the rear side of the recording medium 10. With the aid of a deflection roller 33 as well as further deflection rollers, the recording medium 10 is guided past cooling elements 34 before it is conveyed with the aid of the roller pair 35 out of the module M3 to the further processing (not illustrated). Thus, by providing suitable developer stations 16/1 to 16/5 a performance-adapted printing of the recording medium 10 can be made possible.

The control units of the individual modules M1, M2 and M3 are each connected to a central control unit ST of the printer. The central control unit ST is connected to a device control of the printer that particularly manages print jobs and drives a control panel B. Individual units of the printer are described in every detail in the International Patent Application WO 98/39691. The content of this patent application is herewith incorporated by reference into the present application.

Figure 2:
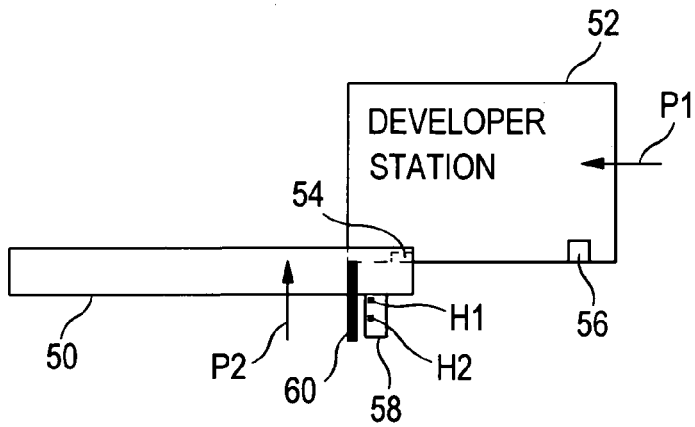
FIG. 2 is a schematic illustration of a developer station of the printer.

FIG. 2 is a schematic illustration of a developer station 52 and a slide rail 50 provided in the printer for receiving the developer station 52. The developer station 52 is one of the developer stations 16/1 to 16/5. In the following the position determination in the printer is explained, for example, for the developer stations 16/1 to 16/5 on the basis of the developer station 52. The slide rail 50 has a slide face arranged substantially in a horizontal plane as well as lateral boundary elements so that the movement of the developer station 52 when it is pushed in and pulled out in the direction of the arrow P1 as well as in the opposite direction is guided by the slide rail 50. At the lower side of the developer station 52, there are provided a cleaning position-locking aperture 54 and a printing position-locking aperture 56. The two locking apertures 54, 56 not only serve for a recognition of the position but also as mechanical stops or lockings which prevent a movement of the developer station 52 in the direction of the arrow P1 or in the opposite direction of the arrow P1. Only by releasing this locking, i.e. by pulling out the locking pin 60 from the respective locking aperture 54, 56, the movement of the developer station 52 can be enabled again, as a result of which the developer station can be moved further in the direction of the arrow P1 or in the opposite direction when the locking pin 60 is pulled out. When the developer station 52 is in the printing position then, even after pulling out of the locking pin 60, the developer station can only be moved in the opposite direction of the arrow P1 since, in the printing position, the developer station 52 is pushed in furthest into the printer. When, however, the developer station 52 is in the cleaning position, then after the release of the locking pin 60, the developer station 52 can be moved in the direction of the arrow P1 into the printer or, for removing the developer station 52, it can be moved out of the printer in the direction opposite to the arrow P1.

Below the slide rail 50, a sensor arrangement 58 comprising two sensor elements H1, H2 is arranged. With the aid of the sensor arrangement 58, the position of the locking pin 60 is monitored. The locking pin 60 is preferably pushed in the direction of the arrow P2 with the aid of a spring (not illustrated). Further, the locking pin 60 can be moved in the direction opposite to the arrow P2 with the aid of a mechanical actuating device, for example a lever (not shown) which is manually actuated. As a result, the locking pin 60 is pushed at maximum out of the sliding plane of the slide rail 50 up to a mechanical stop (not shown) with the aid of the spring force when no developer station 52 is inserted in the slide rail 50. When a developer station 52 is inserted in the printer, as shown in FIG. 2, in that it is placed on the slide rail 50 and is pushed into the printer, the locking pin has to be pushed down so far, either by placing the developer station 52 on the locking pin 60 or by actuating the mechanical actuating device for pushing in the locking pin 60, so that the locking pin 60 no longer protrudes from the slide plane.

Subsequently, the developer station 52 is pushed into the printer in the direction of the arrow P1.

Figure 3:
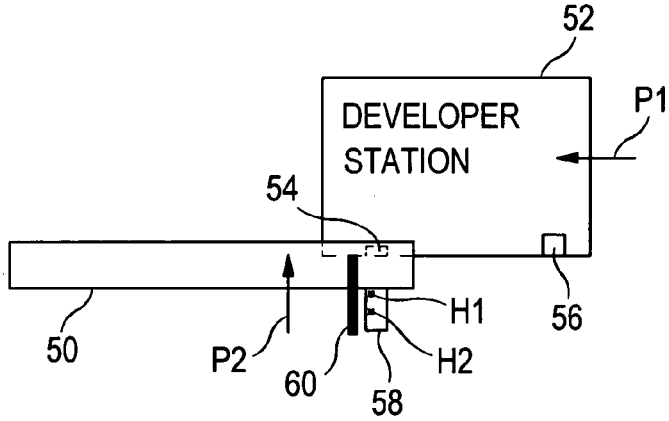
FIG. 3 shows the developer station according to FIG. 2 in a second position.

In FIG. 3, the arrangement of the slide rail 50 and of the developer station 52 according to FIG. 2 is illustrated, the developer station 52 having been pushed further into the printer on the slide rail 50. Identical elements are denoted by identical reference characters. The developer station 52 can be moved freely along the arrow P1 and in the opposite direction in the slide area between the position illustrated in FIG. 2 and the position illustrated in FIG. 3.

Figure 4:
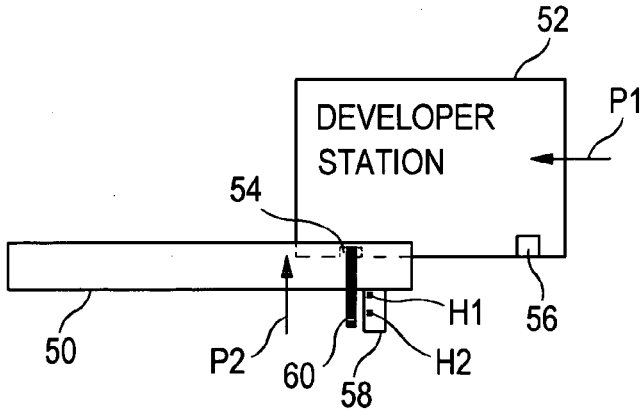
FIG. 4 shows the developer station according to FIGS. 2 and 3 in a cleaning position.

In FIG. 4, the arrangement of the slide rail 50 and of the developer station 52 according to FIGS. 2 and 3 is illustrated, the developer station 52 being in a cleaning position. The locking pin 60 is pushed into the cleaning position locking aperture 54 by the spring force described in connection with FIG. 1. This change in position of the locking pin 60 is detected by the sensor arrangement 58. The exact determination and evaluation of the position of the locking pin 60 with the aid of the sensor arrangement 58 will still be described in more detail in the following in connection with FIG. 6.

By means of the locking pin 60 which is pushed into the cleaning position locking aperture 54, a moving of the developer station 52 in the direction of the arrow P1 or in the opposite direction is no longer possible without releasing the locking pin. Thus, the developer station 52 is substantially fixed in the cleaning position. In order to move the developer station 52 further in the direction of the arrow P1 or in the opposite direction of the arrow P1, the locking pin 60 has to be pulled out of the cleaning position locking aperture 54 by an operator with the aid of the actuating device.

Figure 5:
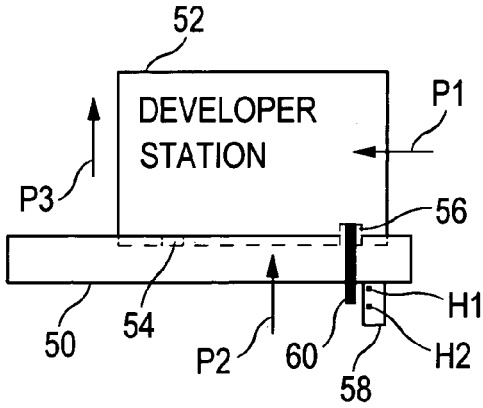
FIG. 5 shows the developer station according to FIGS. 2 to 4 in a printing position.

In FIG. 5, the arrangement of the slide rail 50 in the developer station 52 according to FIGS. 2 to 4 is illustrated, the developer station 52 being in the printing position. For moving the developer station 52 from the cleaning position illustrated in FIG. 4 into its printing position illustrated in FIG. 5, the locking pin 60 is pulled out of the cleaning position locking aperture 54 as already described and the developer station 52 is pushed further in the direction of the arrow P1 until the locking pin 60 engages in the printing position locking aperture 56. In this position, the developer station 52 is in the printing position, however in its swung-out state.

The developer station 52 is moved in the direction of the arrow P3 in order to be swung into contact with the photoconductor belt 13 (not shown). In this sequence, the locking pin 60 is further pushed out of the slide rail 50 so that the sensor arrangement 58 outputs the same signal as in the state in which no developer station 52 is provided in the printer or on the slide rail 50. However, the signal sequence which has precedingly been output by the sensor arrangement 58 can be taken into account by an evaluation circuit so that the swung-into-contact state can clearly be distinguished from a state in which no developer station 52 is inserted in the printer.

Figure 6:
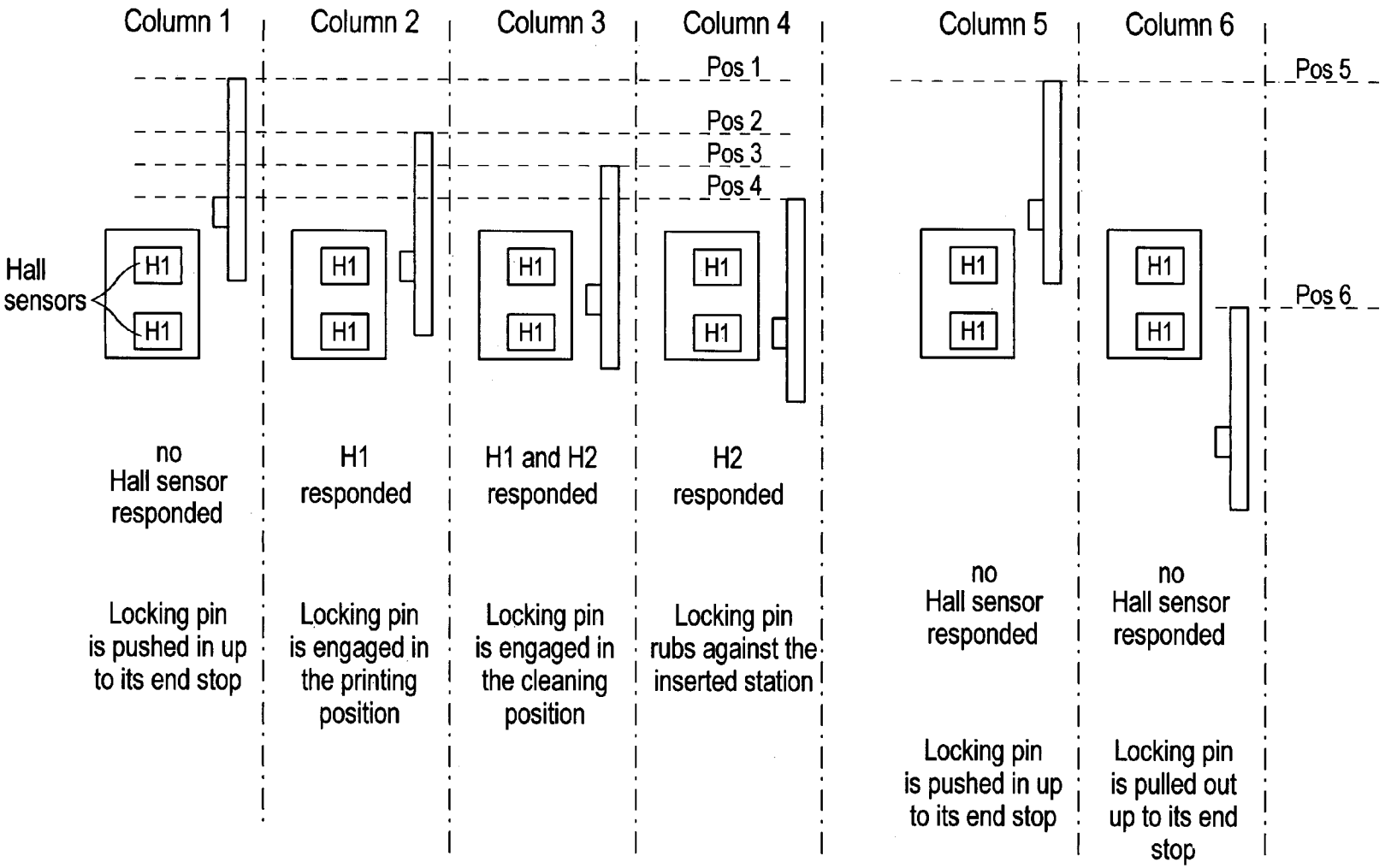
FIG. 6 is a schematic illustration of the position of a locking pin serving as an actuating element with respect to a sensor arrangement comprising two sensors in dependence on the position of the developer station for a total of six positions of the developer station.

In FIG. 6, the position of the locking pin 60 in various operating positions during the insertion of the developer station 52 in the printer is illustrated. In each of the columns 1 to 6, a position of the locking pin 60 and its position relative to the sensor arrangement 58 is illustrated, a reference plate 62 attached to the locking pin 60 serving as an actuating element for the sensors H1 and H2 included in the sensor arrangement 58. The sensors H1 and H2 are Hall sensors which output a signal due to the influence of a magnetic field located near the sensors H1, H2. A permanent magnet is arranged in the reference plate 62 of the locking pin 60 so that when the locking pin 60 moves downward, i.e. when the locking pin 60 is pushed into the slide rail 50 from above or when the locking pin 60 is pulled out downwards by means of the actuating element (already described) in the direction opposite to the arrow P2 according to FIG. 2, the permanent magnet of the reference plate 62 is guided past the sensors H1 and H2, as a result of which the position of the locking pin 60 is detected.

In column 1, the locking pin 60 is pushed up to a mechanical stop with the aid of the spring that has already been described. This stop is implemented with the aid of the reference plate 62 on the slide rail 50 (not illustrated). The further upward pushing of the locking pin 60 out of the slide rail 50 is prevented by this stop. Thus, the position of the locking pin 60 illustrated in column 1 is the position which the locking pin 60 assumes when there is no developer station 52 in the area above the locking pin 60 on the slide rail 50. In this position, the magnetic element in the reference plate 62 is at such a distance from the sensors H1 and H2 that the sensors H1 and H2 output the signal state 0.

In column 2, the position of the locking pin 60 is illustrated in which the locking pin 60 is engaged in the printing position-locking aperture 56. The reference plate 62 comprising the magnet is located directly in front of the sensor H1 so that the same outputs the signal state 1, the magnet still being so distant from the sensor H2 that this sensor H2 continues to output the signal state 0.

In column 3, the position of the locking pin 60 in the cleaning position of the developer station 52 is illustrated. In this position, the locking pin 60 is engaged in the cleaning position locking aperture 54. In contrast to the printing position, the locking pin 60 is pushed further into the slide rail 50 so that the reference plate comprising the magnet is located between the sensors H1 and H2. As a result, the magnetic field of the magnet acts on both sensors H1 and H2 and each of them outputs the signal state 1.

In column 4, the position of the locking pin 60 during the pushing in of the developer station 52 into the printer is illustrated when the developer station 52 is already located above the locking pin 60. The pin, however, is neither engaged in the cleaning position locking aperture 54 nor in the printing position locking aperture 56 so that the underside of the developer station 52 pushes the locking pin 60 into the slide rail 50 so far that its upper edge is flush with the sliding face of the slide rail 50, i.e. is flush with the lower edge of the developer station 52. In this position, the reference plate 62 with the magnet is positioned directly in front of the sensor H2 so that the sensor H2 outputs the signal state 1 and the sensor H1 outputs the signal state 0.

As already described in connection with FIG. 5, the developer station 52 is swung into contact with the photoconductor belt 13 after it has been brought into the printing position. When the developer station 52 is swung into contact with the photoconductor belt 13, it is moved in the direction of the arrow P3 according to FIG. 5 so that the locking pin 60 is pushed out of the slide plane of the slide rail 50 up to the mechanical stop by the spring force acting on the locking pin 60, and the locking pin assumes the same position as in the state in which no developer station 52 has been inserted in the printer. Due to the preceding signal sequence, the situation in which the developer station 52 is swung into contact with the photoconductor belt 13, can, however, be clearly distinguished from the situation in which no developer station 52 is inserted in the printer. This can particularly be determined on the basis of the precedingly determined signal sequence due to a pattern comparison of this signal sequence with a predetermined signal pattern. The magnet provided on the reference plate 62 is arranged at such a distance from the sensors H1 and H2 in the position illustrated in column 5 as well as in the position illustrated in column 1 that each of these outputs the signal state 0.

In column 6, a position of the locking pin 60 is illustrated in which the locking pin 60 has been pulled downwards by the already mentioned actuating element up to a lower stop so that the magnet provided on the reference plate 62 is located far away below the sensors H1 and H2 so that each of the sensors H1 and H2 outputs the signal state 0.

In other embodiments the alternative or additional possibility can be provided that the locking pin 60 is pulled downwards out of the locking apertures 54, 56 with the aid of an electric drive, in particular with the aid of a lifting magnet. Further, in other embodiments it is possible to provide the locking apertures 54, 56 on another side of the developer station 52, for example on a longitudinal side of the developer station 52, and to have the locking pin 60 engage in this aperture from the side. Other sensors, in particular inductive transducers, can also be provided instead of the sensors H1 and H2, then only the reference plate 62 having to be of a suitable metal and a magnetic element not being explicitly required on the reference plate 62.

In other embodiments mechanical switches can also be used instead of the Hall sensors H1, H2. Further, the sensors H1 and H2 or other suitable sensors can output analog signals corresponding to the position of the magnet included in the reference plate 62 which signals are then evaluated by a suitable evaluation circuit. In addition, the developer station 52 is only an example of the position detection and position determination of other units of the printer.

Figure 7:
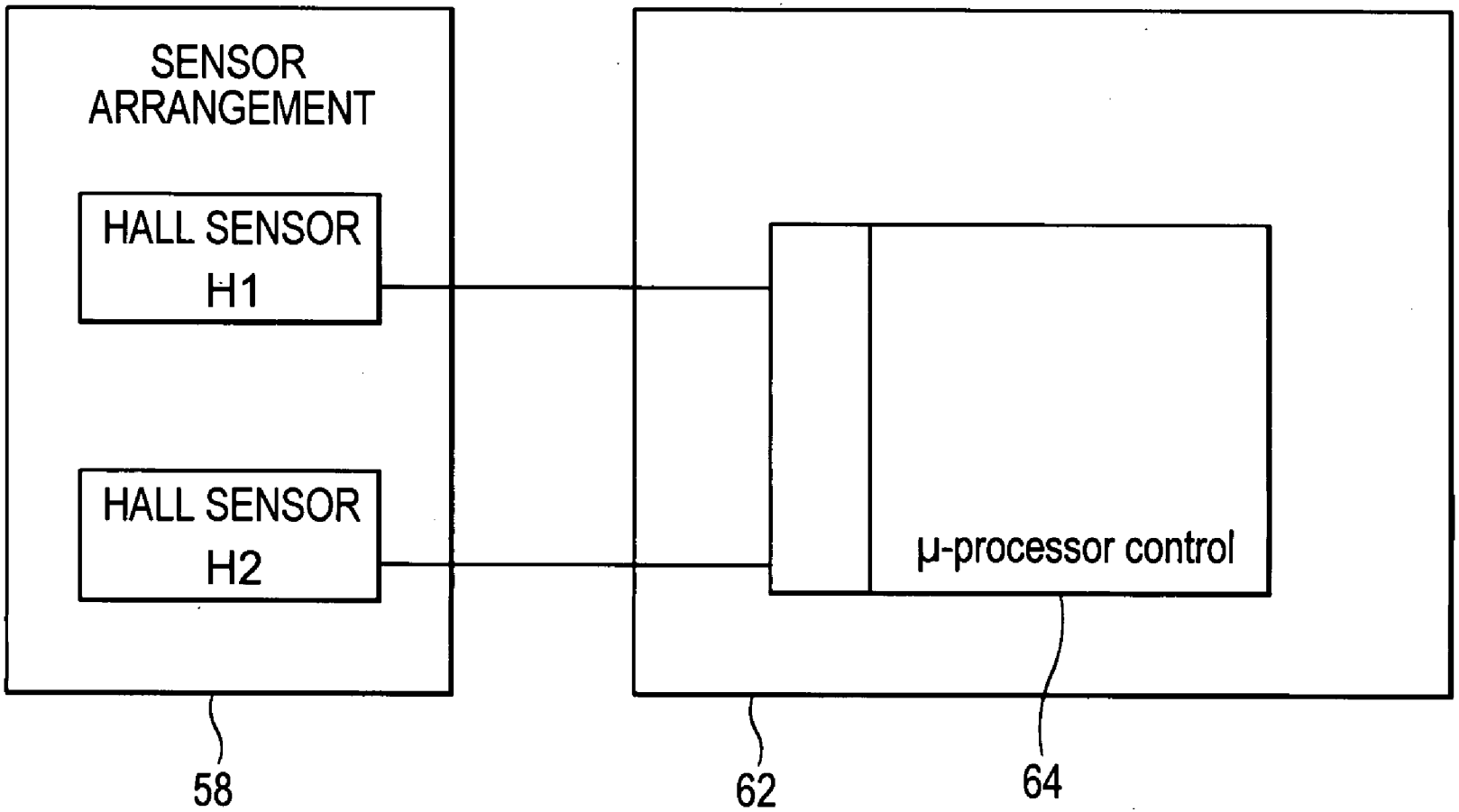
FIG. 7 is a block diagram for evaluating sensor signals.

In FIG. 7, a control unit 62 for monitoring the position of the developer station 52 is illustrated, which control unit 62 is provided in the module M2 according to FIG. 1. The control unit 62 comprises a microprocessor control 64, each of the signal outputs of the sensors H1 and H2 being connected to an interrupt input of the microprocessor control 64. In the case of a change in slope of a sensor signal of the sensors H1, H2, a so-called interrupt service routine of the microprocessor control is carried out each time which can determine the position of the developer station 52 in the printer with the aid of the signal state of the respective other sensor H1, H2 in that it evaluates the position of the locking pin 60. Taking into account the preceding signal sequence, the control unit 62 can thus exactly distinguish relatively easily between the positions 1 to 6 illustrated in columns 1 to 6 and in particular exactly determine the printing position of the developer station 52, as a result whereof faulty operations of the developer station and thus damage to the developer station and/or the printer can be avoided.

By means of a pattern comparison it can further be determined whether one of the sensors H1 and H2 is defective, then suitable measures are taken in order to avoid faulty operations of the printer. For example, an error message can be output at the control panel B and it is prevented that the developer station 52 is swung into contact.

Figure 8:
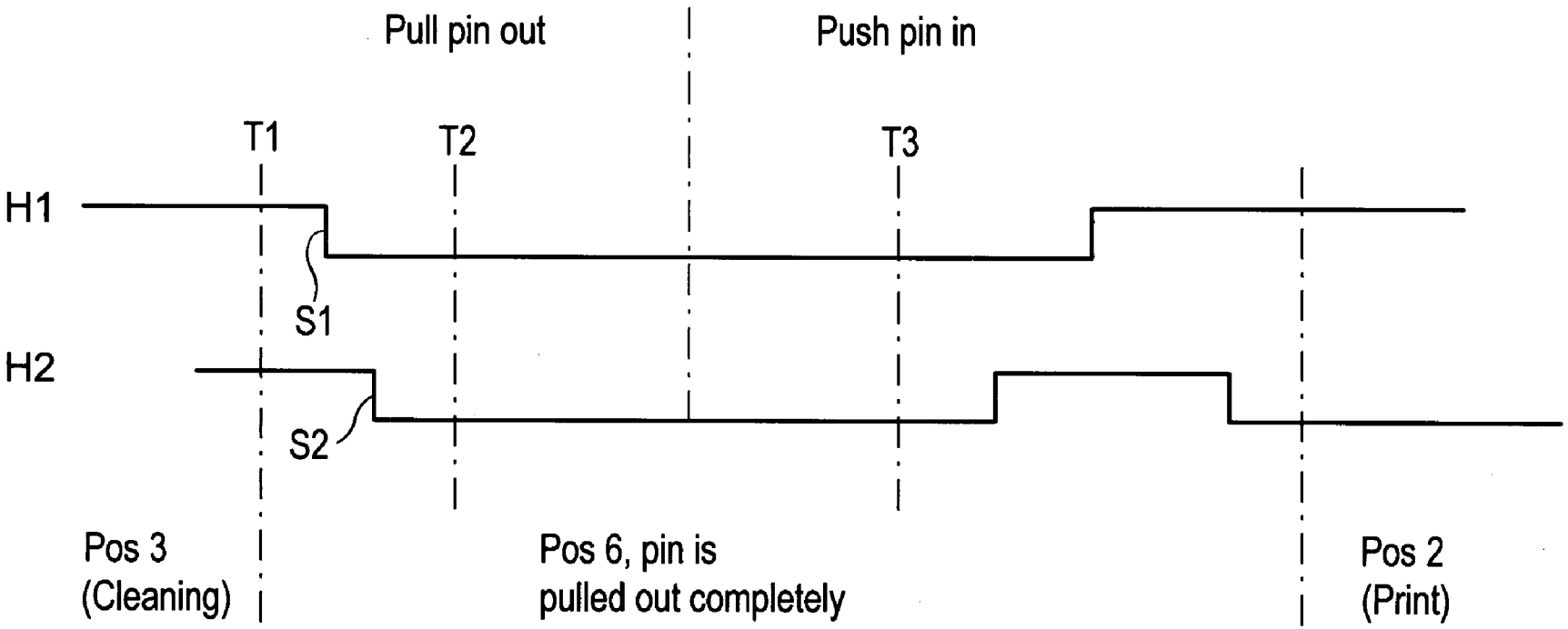
FIG. 8 shows the signal sequence of the sensor signals of a sensor arrangement during the movement of the developer station between the cleaning position and the printing position.

In FIG. 8, the time sequence of the signal sequence is illustrated which is output by the sensors H1 and H2 during the change in position of the developer station 52 from the cleaning position (position 3) to the printing position (position 2). In the cleaning position (position 3) according to FIG. 5, the locking pin 60 is engaged in the cleaning position locking aperture 54 and is thus in position 3 according to FIG. 6. So that the developer station 52 can subsequently be further pushed into the printer, the locking pin 60 is pulled out via the actuating mechanics by the operator and brought into the position 6 according to FIG. 6. Subsequently, the developer station 52 is further pushed into the printer in the direction of the arrow P1 up to the printing position. Before or after the developer station 52 has reached the printing position, the actuating element for pulling out the locking pin 60 is no longer actuated so that the locking pin 60 is pushed into the printing position locking aperture 56. As a result, the locking pin 60 is in the position 2 according to FIG. 6. This signal sequence is compared with a stored signal sequence, as a result whereof defective sensors H1, H2 can be recognized. The printing position (position 2) of the developer station 52 is safely recognized so that the developer station 52 can be swung into contact with the photoconductor belt 13 after the recognition of the position 2.

At the time T1, the developer station 52 is in the cleaning position (position 3). Subsequently, the locking pin 60 is pulled out, as a result of which the signal edges S1 and S2 of the sensor signals H1 and H2 are generated. At the time T2, the pin 60 is pulled out and is in position 6. Subsequently, the developer station 52 is pushed in further. At the time T3, the actuating element for pulling out the locking pin 60 is no longer actuated so that the locking pin 60 is again pushed toward the developer station 52 with the aid of the spring until it is pushed into the printing position-locking aperture at the time T4.

Although in the drawings and in the preceding description a preferred embodiment has been illustrated and described in every detail, this is to be considered as being merely exemplary and as not restricting the invention. It is pointed out that only the preferred embodiment has been illustrated and described and all variations and modifications which are within the scope of the invention at present or in the future are protected.

We claim as our invention:

1. An arrangement for determining a position of a unit in an electrophotographic printer or copier, comprising:

a sensor arrangement comprising two sensors and an actuating element, each sensor outputting a sensor signal dependent on a position of the actuating element, the position of the actuating element with respect to the sensors changing dependent on the position of the unit;

in a first position of the unit the actuating element is positioned such that the first sensor and the second sensor each output a first sensor signal, in a second position of the unit the actuating element is positioned such that the first sensor outputs a second sensor signal and the second sensor outputs the first sensor signal;

in a third position of the unit the actuating element is positioned such that the first sensor and the second sensor each output the second sensor signal; and in a fourth position of the unit the actuating element is positioned such that the first sensor outputs the first sensor signal and the second sensor outputs the second sensor signal.

2. An arrangement according to claim 1 wherein in a fifth position of the unit the actuating element is positioned such that the first sensor and the second sensor each output a first sensor signal.

3. An arrangement according to claim 1 wherein the sensors are stationarily arranged at the printer or copier.

4. An arrangement according to claim 1 wherein the sensor signals comprise binary signals.

5. An arrangement according to claim 1 wherein the unit can be pulled out of and pushed into the printer or copier.

6. An arrangement according to claim 1 wherein the actuating element comprises a mechanical sensing element which senses a sensing area of the unit that includes different levels by which the position of the actuating element is changed when the unit is pulled out or pushed in.

7. An arrangement according to claim 1 wherein the actuating element comprises a mechanical sensing element which senses a sensing area of the unit, the unit comprises a developer station, and the position of the actuating element being changed when the developer station is swung into contact with a photoconductor or when it is swung away from a photoconductor of the printer or copier.

8. An arrangement according to claim 1 wherein the actuating element is formed such that it monitors a locking of the unit in a printing position of the unit.

9. An arrangement according to claim 1 wherein the actuating element is formed such that it locks the unit in a printing position of the unit.

10. An arrangement according to claim 1 wherein the unit comprises a developer station.

11. A method for determining a position of a unit in an electrophotographic printer or copier, comprising the steps of:

providing a sensor arrangement comprising two sensors and an actuating element and outputting with each sensor a sensor signal dependent on a position of the actuating element;

changing a position of the actuating element with respect to the sensors dependent on a position of the unit;

in a first position of the unit positioning the actuating element such that the first sensor and the second sensor each output a first sensor signal, in a second position of the unit positioning the actuating element such that the first sensor outputs a second sensor signal and the second sensor outputs the first sensor signal, in a third position of the unit positioning the actuating element such that the first sensor and the second sensor each output the second sensor signal, and in a fourth position of the unit positioning the actuating element such that the first sensor outputs the first sensor signal and the second sensor outputs the second sensor signal.

* * * * *